US007320409B2

(12) United States Patent
Stagnetto

(10) Patent No.: US 7,320,409 B2
(45) Date of Patent: Jan. 22, 2008

(54) PALLETIZABLE CONTAINER FOR PRESERVING AND TRANSPORTING AGRICULTURAL OR HORTICULTURAL PRODUCTS

(75) Inventor: Jonathan Stagnetto, Gibraltar (GB)

(73) Assignee: Galini Associates Ltd., Gibraltar (GB)

( * ) Notice: Subject to any disclaimer, the term of this patent is extended or adjusted under 35 U.S.C. 154(b) by 0 days.

(21) Appl. No.: 10/535,505

(22) PCT Filed: Nov. 18, 2003

(86) PCT No.: PCT/IB03/05248

§ 371 (c)(1),
(2), (4) Date: May 18, 2005

(87) PCT Pub. No.: WO2004/045984

PCT Pub. Date: Jun. 3, 2004

(65) Prior Publication Data

US 2006/0037883 A1 Feb. 23, 2006

(30) Foreign Application Priority Data

Nov. 20, 2002 (FR) ..... 02 14513

(51) Int. Cl.
*B65D 6/28* (2006.01)
*B65D 8/18* (2006.01)

(52) U.S. Cl. ..... 220/4.27; 206/509

(58) Field of Classification Search ..... 220/4.27, 220/4.26, 501; 206/499, 509, 511, 503
See application file for complete search history.

(56) References Cited

U.S. PATENT DOCUMENTS

| | | | | |
|---|---|---|---|---|
| 3,908,852 | A | 9/1975 | Ricobene et al. | |
| RE29,415 | E * | 9/1977 | Ricobene et al. | 206/550 |
| 4,082,208 | A * | 4/1978 | Lane, Jr. | 224/629 |
| 4,703,857 | A * | 11/1987 | Jahnen et al. | 206/503 |
| 5,197,601 | A * | 3/1993 | Sterett | 206/511 |
| 5,582,297 | A * | 12/1996 | Carter | 206/521.1 |
| 5,730,311 | A | 3/1998 | Curtis | |
| 5,791,509 | A * | 8/1998 | Rush et al. | 220/781 |
| 6,003,719 | A * | 12/1999 | Stewart, III | 220/592.21 |
| 6,394,274 | B1 * | 5/2002 | Cheeseman | 206/511 |
| 2001/0047994 | A1 * | 12/2001 | von Holdt, Jr. | 220/276 |
| 2004/0188507 | A1 * | 9/2004 | Machado et al. | 229/125.015 |

FOREIGN PATENT DOCUMENTS

EP 0 012 666 A1 6/1980

* cited by examiner

*Primary Examiner*—Anthony D. Stashick
*Assistant Examiner*—Harry A Grosso
(74) *Attorney, Agent, or Firm*—Kenyon & Kenyon LLP

(57) ABSTRACT

A palletizable container for preserving and transporting, in a controlled atmosphere and under a controlled pressure, produce (plant material, cheese, microorganisms, seeds, substrates, etc) requiring a particular atmosphere during storage, the container comprising a first portion that is completely impermeable to gas and vapor and a second portion in the form of a member controlling the flow of gas and vapor between the inside of said container and the outside, the first portion comprising a rigid bottom element, intermediate elements in the form of a case having an open upper portion and an openwork bottom, and a cover element, including connection means for fastening and providing a seal between a lower element and an immediately superior element, and the second portion being integrated into the bottom element.

8 Claims, 4 Drawing Sheets

PALLETIZABLE CONTAINER FOR PRESERVING AND TRANSPORTING AGRICULTURAL OR HORTICULTURAL PRODUCTS

This is a 371 national phase application of PCT/IB2003/005248 filed 18 Nov. 2003, claiming priority to French Patent Application No. 0214513 filed 20 Nov. 2002, the contents of which are incorporated herein by reference.

The present invention relates to a rigid, reusable, stackable, and palletizable container intended to receive produce requiring particular conditions for its transport and/or storage for periods of a few days to several months depending on its use and destination. Said container optimizes produce storage by placing the produce in a suitable atmosphere for the entire storage period.

Over time, many kinds of produce undergo irreversible changes; it has long been known that exogenous factors, for example the composition of the atmosphere, temperature, humidity and pressure, have a major influence on the kinetics of chemical reactions involved in such natural phenomena.

At first, chilled enclosures constituted satisfactory solutions. However, their limitations in use rapidly led to systems being added for creating and maintaining an atmosphere with a very precise composition and, more recently, for reducing the pressure inside such enclosures.

Currently, although such enclosures are entirely satisfactory for long-term storage of some plant material such as apples, their large volume makes it unfortunately impossible to adapt them to the ever-increasing logistical complexities of ever increasing distances between production sources and final outlets, and they are suitable only for preserving a large quantity of a single kind of produce per enclosure, which must be unloaded in a single operation.

The state of the art is illustrated in particular in the following French, United States, and European patents FR 1 397 270, FR 1 567 996, FR 2 754 523, U.S. Pat. No. 3,908,852 and EP 0 012 666.

FR 1 397 270 describes a method of preserving agricultural and horticultural produce employing a selectively permeable membrane.

FR 1 567 996 concerns a container for preserving fruit and vegetables using such a selectively permeable membrane. In a first embodiment, the container comprises a completely flexible bag that is impermeable, that is provided with an upper opening for filling, and that has a window in a side face. The window is covered with the selectively permeable membrane that forms an integral part of the container.

FR 2 754 523 concerns a modified atmosphere container for produce such as fresh fruit and vegetables, comprising a cover provided with means for controlling gas exchange between the inside and outside of said container. Means for adjusting the exchange area of said control means are provided on the cover to adapt the exchange area to the produce disposed in the container.

When the container is entirely or partially flexible, the probability of it tearing during handling (loading, unloading, placing on pallets, etc) is high and stacking is impossible.

When the container is in the form of a bag, bagging the produce is difficult and lengthy, and the bag is not suitable for juxtaposing therein individual packages such as crates of fruit or vegetables.

When the different portions of the container are not all secured to one another from the outset, assembly is a difficult operation which requires a great deal of attention, is lengthy, and cannot be automated.

When the air component selective membrane is located on a side face of the container, it interferes with juxtaposing the containers, for example in a freight container.

When means exist for adjusting the air component selective membrane, they consist of manual and non-automatable adjustment of the working area of the membrane. That operation is rendered more difficult since the selective membrane is made difficult to reach in order to protect it.

When the air component selective membrane is integral with the container, it is impossible to replace. Any spoiling of the abilities of the membrane then renders the container unusable.

When the volume of a container cannot be adjusted it is less useful since it has no logistical flexibility, increasing intermediate costs and correspondingly reducing competitiveness.

U.S. Pat. No. 3,908,852 describes a container for preserving produce which comprises a plurality of superposable boxes having openwork bottoms and orifices provided in their corners to avoid the effects of confinement on the produce being stored, creating a constant flow of air inside the container, and above all between the inside of a box and the outside via said orifices.

EP 0 012 666 represents the closest prior art.

That document describes a palletized container for preserving and transporting agricultural or horticultural produce in a controlled atmosphere, comprising a first portion that is completely impermeable to gas and vapor and a second portion in the form of a member controlling the flow of gas and vapor between the inside and the outside, the first portion comprising a rigid bottom element, a side element, and an element forming a rigid cover, said elements being capable of being connected together in a sealed manner. In one embodiment, shown in FIGS. 12 to 15, the second portion is integrated into the bottom element.

Said container can in particular contain crates. The side element is in the form of a flexible material, which may or may not be extensible, which extends between the bottom element and the top element, in particular between belts, and is rigidly and sealingly connected to said belts by any suitable means, for example by adhesive.

That type of container described in EP 0 012 666 means that the crates have to be palletized on the bottom element, then the cover element is positioned and finally, the flexible side element has to be installed, ensuring that it is held and sealed. Clearly, that operation is difficult and requires a great deal of time. Damage to the flexible and fragile wall during handling must be avoided at all times. Further, that type of container is unsuitable for transporting different types of produce on the same pallet.

Starting from the prior art described in EP 0 012 666, the invention proposes a rigid container which can overcome the above-mentioned disadvantages.

The invention is characterized in that the side element is constituted by the peripheral walls of a plurality of rigid, stackable intermediate elements, each intermediate element being in the form of a case having an upper portion that is open and having an openwork bottom, said case being capable of containing loose produce or packed or semi-packed produce, the bottom element, the intermediate elements, and the cover element including connection means for fastening and providing a seal between a lower element and an immediately superior element.

The height of the container is a function of the number of intermediate elements used and of the height of each intermediate element, said height being a function of the type of produce to be stored.

The horizontal section of the elements is preferably selected to fit the format of a traditional pallet. As an example, it may be equal to half or ⅓ of the section of a pallet in order to allow two or three containers to be placed side by side on the same pallet, each container containing produce which is identical to or different from the produce contained in the other container or containers.

The intermediate element with its contents may also be used as an individual container or to display produce at the point of sale, avoiding unnecessary handling of the produce.

Advantageously, the connection means between a lower element and a superior element comprise a downwardly open groove formed at the periphery of the lower zone of the upper element into which the circumference of the upper zone of the lower element is capable of being inserted.

Further, around the groove, the lower zone of each upper element has a rib with a U shaped section and the upper zone of each lower element includes at its periphery a gutter with a U shaped section to receive the rib of the immediately superior element.

Said gutter advantageously acts as a gripping means for an element during handling.

In accordance with an advantageous characteristic of the invention, the gutter or the groove comprises a seal.

In accordance with a further characteristic of the invention, the rib and/or the gutter further includes pins suitable for snap-fastening in corresponding orifices provided in the gutter and/or the rib.

Preferably, each element is generally in the shape of a rectangular parallelepiped.

The member controlling the flow of gas between the inside and outside comprises a deformable flexible portion intended to compensate, up to a predetermined threshold, for variations in pressure resulting from the development of endogenous phenomena (respiration) and/or exogenous phenomena (variations in temperature and external atmospheric pressure, etc) in the inside of the enclosure, and a means allowing gas exchange between the outside and inside of the enclosure, said means, being completely protected against external and internal shocks, being specifically adapted both as regards its positioning and its characteristics, to the quantity of produce disposed in the container, to the specific factors influencing the kinetics of biochemical and/or chemical reactions occurring in the produce, and to the desired storage time.

When deformation of the flexible portion has reached its predetermined level, the volume of the enclosure can no longer vary. Continuation of the endogenous and exogenous phenomena mentioned above will create a pressure differential between the inside and outside of the enclosure. When said differential reaches its predetermined threshold, gas exchange between the outside and inside of the enclosure will occur in response to any additional increase in said pressure differential, via the means allowing said exchange, and preserving the optimal storage conditions. Optionally, the flexible portion could itself constitute the gas exchange means.

The bottom element may receive the liquid fraction (condensates, exudates, etc) formed in the enclosure; it will have trickled down from the top of the container to the bottom element with the help of any suitable means. The intermediate elements, the cover and the bottom element may include any means for fixing any liquid and/or gas fraction that is generated.

The flexible portion, the means allowing gas exchange and any fixing means for the liquid and gas fraction that is generated are readily replaceable for re-use of the elements with which they are respectively associated.

Further, its dimensions adapted to the use of and/or destinations for the produce to be stored means that the container of the present invention may, when not itself serving as an individual container, receive individual containers such as crates which do not form part of the invention. Thus, current practices and systems used by different operators in the fields in which it will be used need not change. It will provide them with a significant economic advantage by allowing stock to be managed constantly, adapting stockdraw to market requirements rather than being dictated to by technical difficulties.

The volume of the container is entirely adjustable and only depends on the number of intermediate elements (which themselves may be of different heights) which are stacked up. Stacking a plurality of containers is possible; different types of produce can be disposed at the same height.

Its ease of use thus renders the field of application of the invention very wide; added to this is the possibility of storing, on the same standard traditional pallet, a plurality of containers containing produce which may be identical or different and which, after breaking out the initial pallet, can be remade into new pallets without affecting the optimum storage conditions for the produce it contains.

By optimizing storage area occupation, in particular in cold rooms, and by improving logistical and operational flexibility, the invention significantly reduces the high intermediate costs carried by produce between its production zone and the end consumer.

The intermediate elements as well as the cover and the bottom element are made of plastics or composite materials or out of any material that is suitable for use, complying with the regulations applicable to the produce disposed inside the container.

Other elements and characteristics of the invention become apparent from the following description made by way of example and with reference to the accompanying drawings in which.

Figure 1:
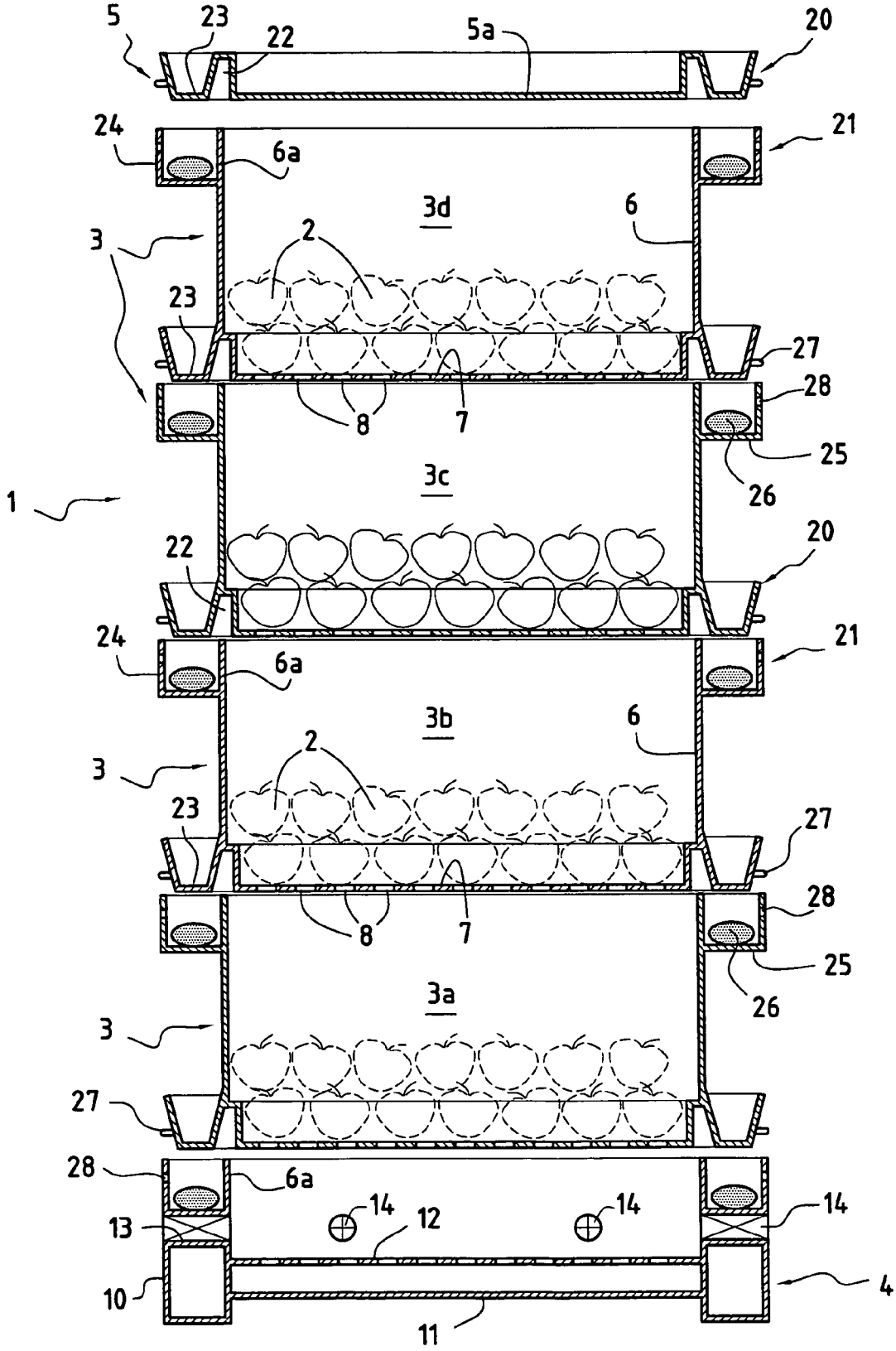
FIG. 1 is a section through a container of the invention in which the various elements of the stack are not nested in one another, for clarity.
Figure 2:
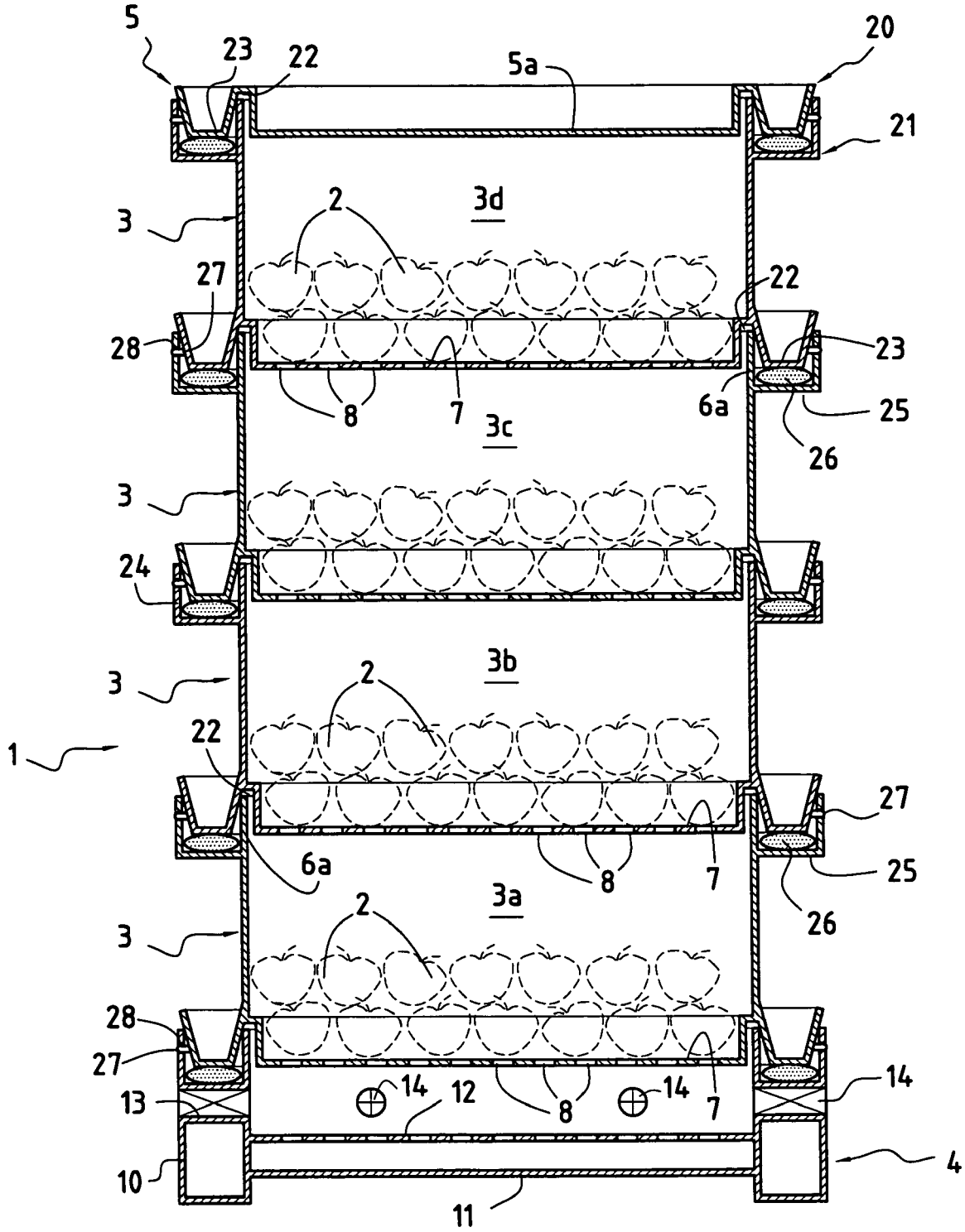
FIG. 2 is similar to FIG. 1 and shows the various elements nested in one another.
Figure 3:
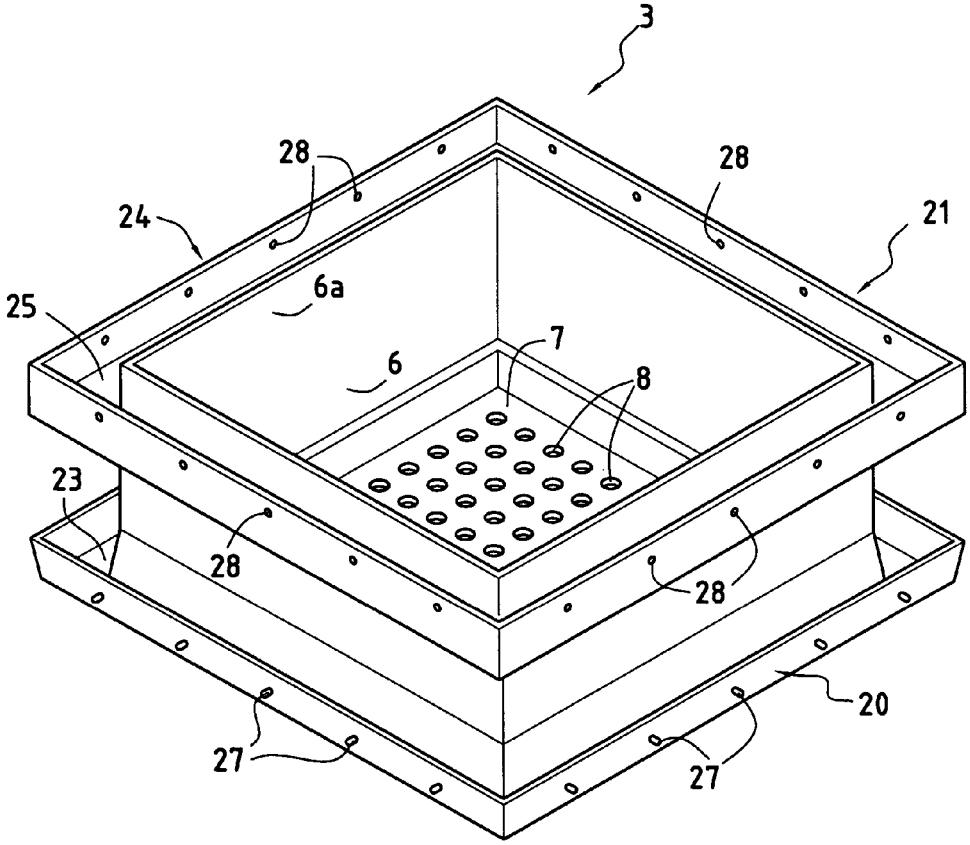
FIG. 3 is a perspective view of an intermediate element.

FIGS. 1 and 2 show a container 1 intended, for example, to contain perishable goods designated by reference numeral 2.

Said container 1 is in the form of a stack of intermediate elements 3 disposed above a bottom element 4 and covered by a cover element 5. All of said elements 3, 4, 5 are generally in the shape of rectangular parallelepipeds and they have the same horizontal section. They may have different heights.

Each intermediate element 3 is in the form of a case which is open at its upper end, having four side walls 6, opposing walls being parallel, and an openwork bottom 7. Said case is intended to receive loose produce or packed or semi-packed produce. The openwork bottom 7 has openings 8 of dimensions that are calculated to prevent produce passing through.

The bottom element 4 has a footing 10 in the form of a frame resting on the ground and having notches for passing ambient air or for passing the forks of a pallet truck or any other handling tool, an openwork bottom 11, and a flexible wall 12 disposed transversely between the edges of the frame 10, and which will deform when there is a pressure difference between the inside of the container 1 and the outside. Said flexible wall 12 is disposed above the openwork bottom 11 and parallel thereto. Above the plane of the flexible wall 12, the edges of the frame 10 also include openings 13 equipped with valves 14 which allow gas or air to be exchanged between the inside of the container and the outside as a function of the pressure difference between the inside of the container 1 and the outside.

The bottom element 4 may have a drain, to receive the liquid fraction which may appear in the container 1.

Advantageously, said drain is disposed at the junction between the frame 10 and the flexible portion 12.

If necessary, the cover element 5 may be provided with a device for extracting air or for injecting gas or a mixture of gases into the container 1 and/or with a humidity regulating device.

The intermediate elements 3 have male connection means 20 on their lower circumference, and on their upper circumference they have female connection means 21 that are complementary to the male connection means 20 in order to provide a sealed connection between two adjacent superimposed intermediate elements.

The cover element 5 also has male connection means 20 on its circumference to cooperate with the female connection means 21 of the top intermediate element 3*d*. The bottom element 4 also has female connection means 21 in its upper portion to receive the male connection means of the bottom intermediate element 3*a*.

The male connection means 20 comprise a groove 22 with an upturned U section opening downwardly formed at the junction of the openwork bottom 7 and the flat wall 5*a* of the cover element 5, and intended to receive the upper portions 6*a* of the side walls 6 of an intermediate element 3 or of the bottom element 4. A rib 23 with a flared U section is formed around the groove 22.

Around the upper ends 6*a* of the intermediate elements 3 and the upper end of the bottom element 4, the female connection means 21 comprise a gutter 24 with a U shaped section defined by the upper end 3*a*, a bottom plate 25 which extends horizontally outwardly from the side walls 6, and a vertical return which extends upwardly from the outer edge of the bottom plate 25. This gutter 24 is intended to receive, at least in part, the U shaped rib 23 of the male connection means 20 of the element 3 or 5 located above it in the stack. A flexible seal 26 is disposed in the bottom 25 of the gutter 24 to ensure a gas-tight seal between the inside of the container 1 and the outside. The gutter 24 also acts as an element for griping an intermediate element 3.

It should be noted that the flexible seal 26 may be disposed in the bottom of the groove 22. The seal 26 then cooperates with the top faces of the side walls 6 of the element located below it.

To completely immobilize the container 1 during transport, the gutter 24 includes holes 28 into which corresponding pins 27 formed in the walls of the U shaped rib 23 of the male connection means 20 penetrate by snap fastening.

The elements 3, 4, and 5 are preferably made of a plastics or composite material or of any other suitable material that satisfies the regulations applicable to the produce disposed inside the container. The walls defining the ribs 23 and the gutters 24 are sufficiently thick to allow the pins 27 to be unclipped by manually moving apart the external walls of the ribs 23 and the gutters 24.

The base of the bottom element 4 and the upper portion of the cover element 5 may also include connection elements that are similar to or different from those described above to allow a plurality of containers 1 to be superposed.

FIGS. 1 and 2 show a container 1 comprising four superposed and identical intermediate elements 3*a*, 3*b*, 3*c*, 3*d*. It is clear that the scope of the invention encompasses the container 1 comprising some different number of intermediate elements 3, and that the heights of these intermediate elements 3 do not need to be identical for all of the intermediate elements 3 of the same stack. What is important is that the male connection means 20 and the female connection means 21 can cooperate together, two by two.

Figure 4:
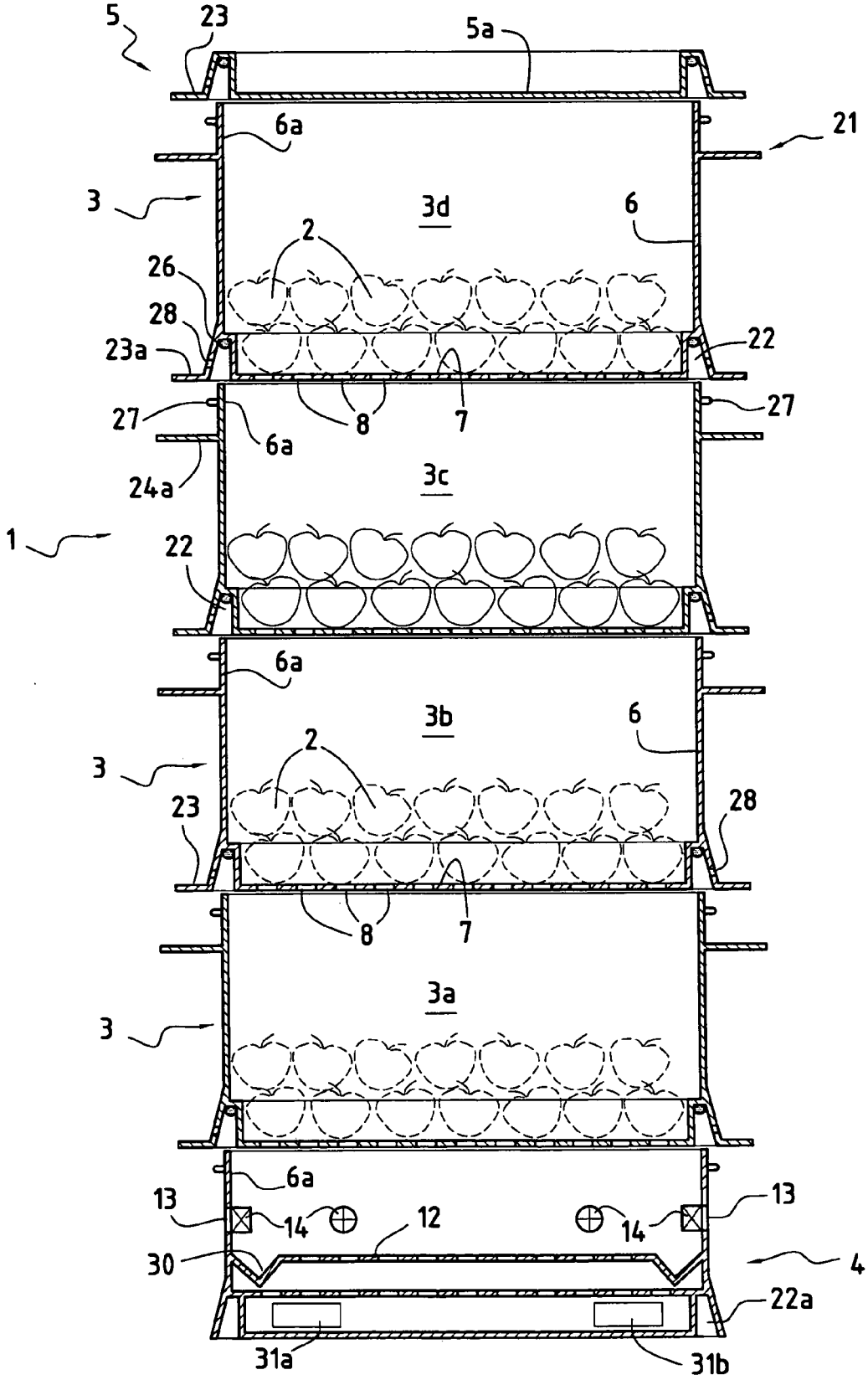
FIG. 4 is similar to FIG. 1 and shows a variation of the container of the invention.

FIG. 4 shows a variation of the container 1 of the invention which differs from that described above in that the seal 26 is disposed in the bottom of the groove 22 and cooperates with the top face of the upper portions 6*a* of the side walls 6 of a lower intermediate element 3 or of the bottom element. The rib 23 and the gutter 24 are replaced by horizontal walls 23*a* and 24*a* which extend outwardly and which can serve as gripping means.

The pins 27 are formed on the outer face of the upper portions 6*a* and are capable of cooperating with the holes 28 formed in the outer wall of the grooves 22.

The footing 10 of the bottom element 4 also comprises a groove 22*a* in its lower zone which is complementary to the groove 22 of the cover element 5. This disposition allows a plurality of containers 1 to be stacked.

Above the flexible wall 12, the walls of the bottom element 4 have small orifices 13 (such as air holes). Valves 14 are located on the inner face of the bottom element, facing the orifices 13, directly or on a support. The valves are thus protected while being easy to access to replace if necessary.

Reference numeral 30 designates a drain formed around the flexible membrane 12 to receive the liquid fraction which may appear in the container 1.

Reference numerals 31*a* and 31*b* designate openings provided in the footing 10 to pass the forks of a handling tool such as a pallet truck. In this case, the footing 10 may act as a traditional pallet.

The various intermediate elements are intended to receive either loose produce or semi-packed or packed produce. The invention can be used with all kinds of produce (plant material, cheese, microorganisms, seeds/substrates, etc.) requiring a particular environment, in particular as regards atmospheric composition and/or temperature and/or humidity and/or pressure during storage.

Regarding its application to the storage or transport of fruit, vegetables, or horticultural produce, continuing respiration of produce present in the container is observed to cause a reduction in the gas volume inside the container 1.

Since the container 1 forms a sealed and rigid enclosure where only the flexible wall 12 is movable, said flexible wall deforms up to a predetermined threshold beyond which any additional deformation is impossible. In other cases in which the volume inside the container 1 increases, the flexible wall 12 deforms in the other direction from its equilibrium position, up to a predetermined threshold beyond which any additional deformation of said flexible wall is impossible.

When storage under reduced pressure is required, a predetermined pressure differential activates the valve 14 and gas exchange between the inside and outside of the container 1 or between the outside and inside, as the case may be.

The flexible wall 12 could optionally itself act as a valve.

The invention claimed is:

1. A palletizable container for preserving and transporting, in a controlled atmosphere and under a controlled pressure, any produce requiring a particular atmosphere during storage, the container comprising:

a bottom element having wall means completely impermeable to gas and vapor, a member controlling the flow of gas and vapor between an inside of said container and an outside, said member being integrated into said wall means, a plurality of rigid stackable intermediate elements, each having an open upper portion, an openwork bottom, and side peripheral walls completely impermeable to gas and vapor, and each being capable of containing loose, packed or semi-packed produce, a rigid cover element completely impermeable to gas and vapor, connection means for fastening the bottom element, the peripheral wails, and the cover element to each other, said connection means being included in the bottom element, in the intermediate elements, and in the cover element, means for providing a seal between the bottom element, the peripheral walls, and the cover element so that they are connected in a sealed manner, wherein the connection means comprise a downwardly open groove formed on a lower circumference of each of the intermediate elements and of the cover element, into which an upper circumference of the element stacked immediately below one of the intermediate elements or the cover element is capable of being inserted, and the lower circumference of each of the intermediate elements and of the cover element also has, around the groove, a rib with a U shaped section and the upper circumference of each of the intermediate elements or bottom element comprises at its periphery a gutter with a U shaped section to receive the rib of the element stacked immediately above one of the intermediate elements or the bottom element.

2. A container according to claim 1, wherein the gutter or the groove comprises a seal.

3. A container according to claim 1, wherein the rib and/or the gutter further includes pins which can snap fasten into corresponding holes provided in the gutter and/or the rib.

4. A container according to claim 1, wherein each element is generally in the shape of a rectangular parallelepiped.

5. A container according to claim 1, wherein the elements are made of a plastics material or of a composite material or of any suitable material.

6. A container according to claim 2, wherein each element is generally in the shape of a rectangular parallelepiped.

7. A container according to claim 2, wherein the elements are made of a plastic material or of a composite material or of any suitable material.

8. A container according to claim 2, wherein the rib and/or the gutter further includes pins which can snap fasten into corresponding holes provided in the gutter and/or the rib.

* * * * *